United States Patent [19]

Scheiber

[11] 4,182,782

[45] Jan. 8, 1980

[54] METHOD OF A COATING ON THE OUTSIDE SURFACE OF A METAL PIPE

[75] Inventor: Werner Scheiber, Frankfurt am Main, Fed. Rep. of Germany

[73] Assignee: Metallgesellschaft Aktiengesellschaft, Frankfurt am Main, Fed. Rep. of Germany

[21] Appl. No.: 906,128

[22] Filed: May 15, 1978

Related U.S. Application Data

[63] Continuation of Ser. No. 616,314, Sep. 24, 1975, abandoned.

[51] Int. Cl.[2] ..... B05D 3/02

[52] U.S. Cl. ..... 427/195; 118/309; 118/DIG. 11; 427/318

[58] Field of Search ..... 427/181, 182, 185, 195, 427/318; 118/309, DIG. 11

[56] References Cited

U.S. PATENT DOCUMENTS

| | | | |
|---|---|---|---|
| 3,161,530 | 12/1964 | Strobel | 427/185 |
| 3,197,324 | 7/1965 | Brooks | 427/185 |
| 3,508,946 | 4/1970 | Plueddemann | 427/195 X |
| 3,560,239 | 2/1971 | Facer et al. | 427/185 X |
| 3,573,953 | 4/1971 | Laulan | 427/185 |
| 3,589,333 | 6/1971 | Quackenbush | 427/195 X |
| 3,922,384 | 11/1975 | Tadewald | 427/185 X |
| 3,946,125 | 3/1976 | Scheiber | 427/46 |
| 3,974,306 | 8/1976 | Inamura et al. | 427/195 |

FOREIGN PATENT DOCUMENTS

| | | | |
|---|---|---|---|
| 993566 | 5/1965 | United Kingdom | 427/185 |

*Primary Examiner*—Shrive P. Beck
*Attorney, Agent, or Firm*—Karl F. Ross

[57] ABSTRACT

A method of coating metal pipes externally with a uniform thin coating of a synthetic resin, such as a polyamide, polyethylene or polyvinyl chloride, which comprises heating the pipe to a temperature to enable a frit of discrete particles to bond to a pipe in a chamber through which the pipe is passed and which is charged with a mixture of a gas and the particles. Thereafter the frit is smoothed by heating the pipe to a higher temperature as it leaves the chamber to cause the particles to coalesce.

1 Claim, 2 Drawing Figures

METHOD OF A COATING ON THE OUTSIDE SURFACE OF A METAL PIPE

This is a continuation of application Ser. No. 616,314, file 24 Sept. 1975 and now abandoned.

CROSS-REFERENCE TO RELATED APPLICATIONS

This application is related to and extends principles described in my copending commonly assigned application Ser. No. 476,031 filed 3 June 1974 (U.S. Pat. No. 3,965,854) and entitled METHOD OF AND APPARATUS FOR COATING OF HOLLOW BODIES, my commonly assigned copending application Ser. No. 474,081 filed 28 May 1974 (U.S. Pat. No. 3,946,125) and entitled METHOD OF AND APPARATUS FOR INTERNALLY COATING DUCTS WITH SYNTHETIC RESIN, both applications referring to my earlier application Ser. No. 375,009 of 29 June 1973 (issued 4 Feb. 1975 as U.S. Pat. No. 3,864,149) which, in turn, refers to my application Ser. No. 191,940 of 22 Oct. 1971 (issued 4 Mar. 1975 as U.S. Pat. No. 3,869,300).

FIELD OF THE INVENTION

The present invention relates to a method of continuously producing a synthetic-resin coating on the outside surface of a metal pipe by powder deposition and fusion.

BACKGROUND OF THE INVENTION

It has been proposed to produce a thin coating film on a metal pipe by conducting a preheated pipe through a coating chamber in which the pipe is exposed to a turbulent air stream charged with a metered quantity of a coating powder.

In such a process it is desired that the synthetic-resin coating should adhere very firmly to the metal surface and form a smooth and homogeneous film having as uniform a thickness as possible over the entire coated surface.

In order to meet these requirements it has already been proposed to bring the pipe that is to be coated into contact with a pulverulent coating material which will fuse on the hot surface of the pipe, by depositing the coating material after it has been fluidized in an ascending turbulent gas stream. Upon raising of the gas pressure as is conventional when depositing liquids, the fusible coating material is carried from a storage container over the pipe located above the container, and a coating is thus formed.

Another previously proposed process provides elongate articles, particularly pipes, with coatings by the fluidized-solids sintering technique, the pipe which is to be coated being preheated and horizontally passed through a fluidized solids sintering container provided in its sides with entry and exit openings for the travelling pipe, a pressure above the fluidized bed being maintained below that of the ambient atmosphere.

It has also been proposed to coat the external surface of a pipe with an infusible resin by a process in which a pulverulent organic resin which is temporarily softened by heat is fluidized and thus deposited on the preheated pipe. The resin employed in this process is a mixture of epoxy resin and hardener.

These various processes and the apparatus employed permit pipes to be provided with homogeneous coatings which adhere firmly to the pipe surface.

Nevertheless, considerable difficulties are still experienced when very long pipes of very small internal cross-section are to be provided with synthetic-resin coatings of uniform thickness.

Pipes of small diameter can be easily and quickly heated but the applied heat is just as quickly dissipated, and it is no simple matter to provide such pipes during the process of coating with heat at a uniform rate to maintain the desired temperature in order to produce a coat that is of the same thickness everywhere.

It is also difficult to coat long pipes which stand upright with a turbulently suspended synthetic-resin powder because, although a coating of satisfactory thickness may be produced at the bottom end of the pipe, pressure loss of the fluidizing gas results along parts of the pipe higher up and particularly at the top, resulting in a coating of inadequate thickness. These difficulties can be somewhat alleviated if preheated pipes are conducted horizontally through a fluidizing container. However, it is still not easy to provide the fluidizing container with seals suitable for the passage of pipes of different diameters. Moreover, it is also not easy to maintain a constant pressure below that of the ambient atmosphere in the space above the fluidizing bed.

However, the principal shortcoming of these and other known fusion-coating techniques is that they do not permit the application of thin synthetic-resin (of a thickness below say 200 μm) to thin-walled pipes. In order to permit this to be successfully done, the coating must be formed by a synthetic-resin powder having a grain size under 80 μm., but such grain sizes are unsuitable for fluidization, for instance in fluidized-solids sintering, because the powder will not then settle. All the above mentioned fluidization techniques require powders having grain sizes between 80 and 250 μm..

In principle electrostatic powder spraying of, for example, epoxy resins followed by hardening (K. Brown, Ind.-Lackier-Betr., 38 (1970)) permits thin coatings to be applied to pipes, but these and similar methods can be performed only at low speeds of travel of the pipes that are being coated. Even if a large and costly number of spray guns are used and simultaneously operated uniform coating films cannot be successfully obtained, primarily due to the electrostatic attraction between the powder grains.

OBJECTS OF THE INVENTION

It is therefore an object of the present invention to provide the outsides of pipes of varying diameters, particularly of small diameter pipes, with a substantially homogeneous, smooth, thin synthetic-resin coating of uniform thickness.

It is another object of the invention to provide a method of applying uniform-thickness but relatively thin coatings to a relatively long thin-wall pipe whereby the disadvantages of earlier systems, as enumerated above, can be avoided.

It is still another object of the invention to provide an improved apparatus for externally coating pipes of the character described with synthetic resins.

According to one aspect of the present invention there is provided a method of continuously producing a synthetic-resin coating on the outside surface of a metal pipe, wherein the pipe is conducted through a coating chamber in which it is exposed to a turbulent air stream charged with a metered quantity of a synthetic-resin powder, after the pipe has been heated to a temperature which is not higher than necessary for a synthetic-resin coating of frit to form on the pipe, and wherein the synthetic-resin coating of frit is then smoothed by fusion by heating the pipe to a higher temperature after it leaves the chamber. The term "frit" is here used to describe a layer of discrete noncoalesced particles substantially point-bonded to the pipe and/or each other, the layer being, however, coherent.

The synthetic-resin powder is preferably suspended in turbulent air in a quantity of 0.5 to 5 (preferably 1 to 2) kg. per cubic meter (kg/m$^3$), and is blown over the surface of the metal pipe preferably at a velocity exceeding 30 and more preferably from 30 to 80 meters/-second (m/sec).

The synthetic-resin powder desirably has a grain size below 100 μm., preferably from 20 to 80 μm.

According to another aspect of the present invention there is provided apparatus for continuously producing a synthetic-resin coating on the outside surface of a metal pipe, wherein a cylinder through which the pipe is intended to pass has a nozzle-shaped entry, an inlet for a mixture of synthetic-resin powder and air, and an extracting chamber, wherein there are provided an extractor for the powder-air mixture consisting of a cyclone for separating the air from the powder, a fan, a charging box and an injector for metering the powder into the air stream.

SPECIFIC DESCRIPTION

Figure 1:
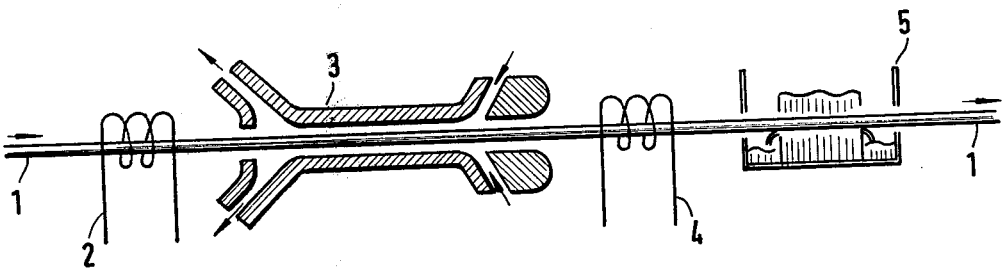
FIG. 1 is a diagrammatic and illustrative flow sheet illustrating a method of continuously producing a thin coating on the outside of a thin-walled metal pipe.

Referring now to FIG. 1, a pipe 1 to be coated, is passed in succession through an induction coil 2, a coating head 3, a second induction coil 4 and a cooler 5, as the pipe is longitudinally displaced in the direction represented by the arrows.

Figure 2:
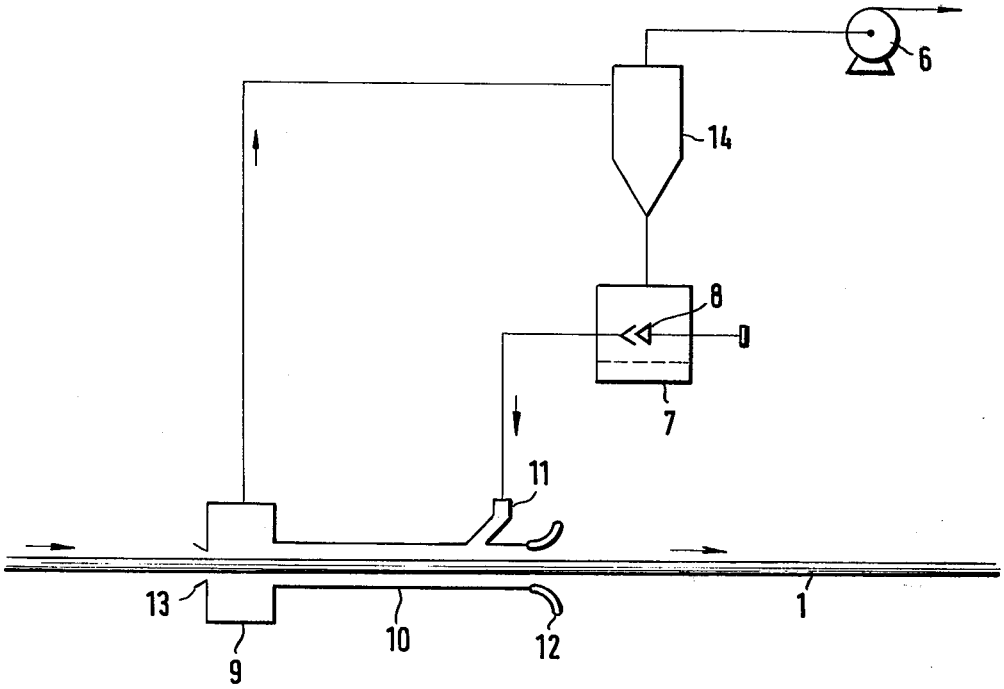
FIG. 2 is a diagram for apparatus for performing the method.

The apparatus shown in FIG. 2 comprises a fan 6, a charging box 7, an injector 8 for metering synthetic-resin powder into the air stream, an extraction chamber 9, a cylinder 10, an inlet 11 to the cylinder, a nozzle-shaped exit 12 to the cylinder, an entry 13 for the pipe to be coated and a cyclone 14.

In the operation of the apparatus, the fan 6 maintains a subatmospheric pressure (suction or vacuum) inside the cylinder 10 through which the pipe that is to be coated travels. A mixture of synthetic-resin powder and air supplied by the injector 8 from the charging box 7 is therefore forced to sweep along the pipe 1 to the extraction chamber 9 for coating the pipe, and it cannot escape through the nozzle-shaped exit 12 and the entry 13 at the ends. In the cyclone 14, the powder is separated from the air and returned into the charging box 7, so that the fan 6 will not be exposed to the powder while it maintains the necessary suction in the coating head.

SPECIFIC EXAMPLES

The invention will now be further illustrated by the following examples:

EXAMPLE 1

A coil of annealed soft iron pipe of 12 mm. internal diameter and 1 mm. wall thickness is provided with a synthetic resin coating of polyamide 11 (polyundecanamide) 120 μm. thick. The pretreated pipe was uncoiled and straightened and then introduced into the coating apparatus shown in the drawing. The apparatus comprised an induction coil 2, a coating head 3, a second induction coil 4 and a cooler 5. The pipe was drawn through the induction coil 2 where it was heated to a temperature of 195° C. and then through the coating head at a speed of 20 meters/minute. In the coating head 3, a turbulent stream of air in which 1.5 kg. per cub. meter of polyamide 11 powder having a grain size of 20 to 50 μm. had been suspended was conducted at a flow velocity of 50 meters/sec. in countercurrent to the travelling pipe. Upon leaving the coating head 3, the pipe 1 was covered with a uniform layer of synthetic-resin frit about 140 μm. thick. The externally velvety rough coat of frit had fused continuously only at the interface with the metal, externally the several synthetic-resin grains were merely retained by adhesion at their points of contact. However, in the following induction coil 4 the pipe 1 was heated to 240° C. and the uniform but rough synthetic-resin film of frit fused and coalesced to assume an extremely smooth surface.

The pipe was then cooled in the water tank of the following cooler 5.

The resultant firmly adhering fully fused synthetic-resin coating film of polyamide 11 proved to be 120±5 μm. thick.

COMPARATIVE EXAMPLE 1

Coating was performed as described in Example 1, except that all the heat was supplied by the induction coil 2, induction coil 4 remaining out of action.

With the aid of the indication coil 2 the temperature of the pipe surface was raised to 195, 220, 240 and 260° C.

| Temp. pipe surface | Resultant coating |
|---|---|
| 195° C. | even film of frit 140 μm. thick, |
| 220° C. | uneven film, partly fused, film thickness 160 μm. |
| 240° C. | fused film, thickness 180 μm. pronounced orange peel effect, |
| 260° C. | fused film permeated with bubbles. |

EXAMPLE 2

The pipe described in Example 1 with a coat of high pressure polyethylene 200 μm. thick. The high pressure polyethylene used had a grain analysis between 40 and 80 μm, a fusion index according to DIN (German Industrial Standard) Specification No. 53,735 of 30 g/10 min., and a melting range according to DIN Specification No. 53,181 of 110 to 130° C. The pipe 1 was preheated to 140° C. in the coil 2 and, inside the coating head 3, the polyethylene powder was carried in countercurrent to the travelling pipe under otherwise the same conditions as in Example 1.

Upon leaving the coating head, a uniform film of polyethylene 240 μm. thick had been deposited on the pipe 1 in the form of a frit. In the second induction coil 4 the pipe was then heated to 190° C. and the film fused before being cooled in the water bath of the cooler 5. The resultant final coating had a thickness of 200±10 μm.

COMPARATIVE EXAMPLE 2

The coating was applied as described in Example 2 except that the supply of heat was exclusively by means of the induction coil 2, the other induction coil 4 being left out of action.

With the aid of the induction coil 2 the temperature of the pipe surface was raised to 150°, 190° and 210° C.

| Temp. of pipe surface | Resultant coating |
|---|---|
| 150° C. | locally fused, film thickness 250 μm. |
| 190° C. | pronounced orange peel effect, film thickness 270 μm. |
| 210° C. | large quantities of bubbles, film thickness exceeding 280 μm. |

EXAMPLE 3

The outside of the metal pipe described in Examples 1 and 2 with a soft polyvinyl chloride coating 160 μm. thick. The soft polyvinyl chloride used had a density of 1.4 g./cc. and a melting range according to DIN Specification No. 53,181 of 170 to 200° C. The grain analysis was from 40 to 80 μm. The coating was applied in the same way as in Examples 1 and 2. The temperature of frit formation was 210° C., the frit film being smoothed by fusion at 230° C. A firmly adherent film having a thickness of 160±10 μm. was obtained.

COMPARATIVE EXAMPLE 3

The coat was again applied as in Example 3 except that heat was supplied exclusively by the induction coil 2, whereas the induction coil 4 remained inactive.

The pipe surface was heated by the induction coil 2 to temperatures of 210°, 230° and 250° C.

| Temp. of pipe surface | Resultant coating |
|---|---|
| 210° C. | a uniform film of frit, thickness of 170 μm. |
| 230° C. | melt locally contracted, 190 μm. considerable fusing, |
| 250° C. | severe decomposition phenomena and sweating out of hydrochloric acid. |

With the present method it is possible in a simple and economical manner to provide the outside surface of a pipe with a homogeneous and firmly adherent thin synthetic-resin coating, for instance from 100 to 200 μm. thick.

By exposing the pipe to a continuous stream of turbulent air charged with a synthetic-resin powder it is possible to control the quantity of powder that is made available for fusing on the pipes, i.e. the quantity of powder per unit volume of air, in such a way that uniform films are obtained and that the beginning and end of the pipe are also both evenly coated. Moreover, the method is continuous and there is substantially no powder loss.

The surprising fact that two-stage heating comprising applying a thin synthetic-resin film of frit on the first stage and then fusing the film in the second stage obviates the appearance of flaws in the resultant plastic film, enables very thin-walled pipes which have a low heat storage capacity to be successfully and evenly sheathed at high speed with synthetic resins.

An advantage of the present apparatus is it permits even thin-walled metal pipes to be provided with a thin coating film at a high rate of throughput, a result previously proposed apparatus was not able to achieve. For example, compared with a conventional electrostatic powder coating plant, the present apparatus is extremely compact, a factor of major importance for continuous operation or for treating endless pipes. Electrostatic equipment must necessarily occupy considerable space because the production of the required film thicknesses at the low powder concentrations of 10 g. powder per cub.m. that are prescribed to avoid powder explosions, necessitate long treating paths (Merkblatt für elektrostatisches Pulverbeschichten, October 1971: Carl Heymanns Verlag K.G. Cologne, page 4). The present apparatus can be fully automatically controlled and enables reproducible results to be obtained. Substantially no powder losses occur so that the environment remains free from pollution by dust.

I claim:

1. In a method of coating an external surface of a metal pipe with a synthetic resin comprising heating the pipe to a temperature sufficient to permit particles of said synthetic resin to adhere as a frit to the external surface of the pipe but below that at which said particles coalesce, thereafter heating said pipe to a temperature higher than the first-mentioned temperature and sufficient to cause the frit to coalesce and form a smooth coating on said external surface, and cooling said pipe, the improvement which comprises in combination:

(a) heating the pipe to a temperature of 140° to 210° C.;

(b) passing the heated pipe through a chamber at a speed of about 20 m/min, said chamber supplied with a turbulent air stream homogeneously charged with 1.0 to 2.0 kg/m$^3$ of a thermoplastic synthetic resin powder selected from the group of polyamides, polyethylene and polyvinyl chloride constituting said particles;

(c) blowing the mixture of said air stream and said particles over along and parallel in countercurrent to the surface of the pipe at a velocity of 30 to 80 m/sec, thereby maintaining a relative velocity between pipe and the air stream containing the powder of about 50 m/sec;

(d) charging said synthetic resin powder into said air stream with a grain size from 20 to 80 microns, the thickness of the fritted synthetic resin amounting to 140 to 240 microns;

(e) heating said pipe to a temperature of 190° to 240° C.; and (f) cooling the coated pipe following step (e) and obtaining a thickness of the smooth coating of 120 to 200 microns.

* * * * *